US007355582B1

(12) United States Patent
Bell

(10) Patent No.: US 7,355,582 B1
(45) Date of Patent: Apr. 8, 2008

(54) SWITCHED CAPACITOR CYCLIC DAC IN LIQUID CRYSTAL DISPLAY COLUMN DRIVER

(75) Inventor: Marshall J. Bell, Chandler, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 605 days.

(21) Appl. No.: 10/850,972

(22) Filed: May 21, 2004

(51) Int. Cl.
*G09G 3/36* (2006.01)

(52) U.S. Cl. ..... 345/100; 345/93; 345/98; 345/204

(58) Field of Classification Search ..... 345/100, 345/98, 93, 204
See application file for complete search history.

(56) References Cited

U.S. PATENT DOCUMENTS

| | | | | |
|---|---|---|---|---|
| 6,788,231 | B1 | 9/2004 | Hsueh | |
| 6,801,149 | B2 * | 10/2004 | Walton et al. | 341/150 |
| 6,930,665 | B2 * | 8/2005 | Sekine | 345/100 |
| 2002/0063666 | A1 | 5/2002 | Kang et al. | |
| 2005/0099549 | A1 | 5/2005 | Chen et al. | |
| 2006/0192741 | A1 | 8/2006 | Hirakawa et al. | |

OTHER PUBLICATIONS

National Semiconductor Corporation, "LCD TV TFT-LCD Timing Controller with PPDS Interface", FPD48084, May 2004, pp. 1-2.
U.S. Appl. No. 10/850,973, Non-Final Rejection, filed Jul. 19, 2007.
U.S. Appl. No. 10/850,973, Application as filed, filed May 21, 2004.

* cited by examiner

*Primary Examiner*—Richard Hjerpe
*Assistant Examiner*—Leonid Shapiro
(74) *Attorney, Agent, or Firm*—Darby & Darby PC; John W. Branch

(57) ABSTRACT

A method and circuit for providing analog voltages to an LCD panel based on digital voltages. A gamma curve defining a relationship between the applied voltage and a luminescence of the liquid crystals is implemented in a timing controller through a look-up table, an algorithm, and the like. The digital grey level values provided by the timing controller are converted to analog voltages by a linear switched capacitor cyclic digital-analog-converter (DAC) in each column driver. Switches are set in a different configuration for each conversion cycle allowing charges to be accumulated in capacitors based on a value of an input bit. The DAC converts starting with a least significant bit. Linear operation allows handling of larger amounts of data without increasing circuit size significantly. A capacitor mismatch error may be reduced significantly by swapping capacitor configuration every other cycle or frame.

21 Claims, 6 Drawing Sheets

SWITCHED CAPACITOR CYCLIC DAC IN LIQUID CRYSTAL DISPLAY COLUMN DRIVER

FIELD OF THE INVENTION

The present invention relates to Liquid Crystal Display (LCD) drivers, and, in particular, to a switched capacitor cyclic digital-analog-conversion (DAC) circuit that provides an alternative to non-linear resistive DAC circuitry commonly used in LCD column drivers.

BACKGROUND

With major advances in various aspects of LCD technology, LCD's are being employed in many devices ranging from color cellular phone displays to most sophisticated medical equipment. For such diversity of use, different characteristics are desired. For example, durability, robustness, and the like are desirable for LCD panels to work under a wide range of circumstances such as temperature, humidity, mechanical stress, and the like.

For LCD's to be implemented in high end video applications such as large screen TV's, a capability to handle large amount of data, to provide brightness uniformity, to compensate for temperature-induced gamma gradients, and the like are desirable of the LCD circuitry. While addressing these issues, the size of the circuitry from a manufacturing cost and reliability perspective is among parameters that are taken into consideration.

A non-linear resistive (R-DAC) architecture may provide an adequate number of gray levels, for example 64 in 6-bit systems, while intrinsically correcting for gamma of the LCD. However, the R-DAC architecture results in a significant die area growth for higher grayscale precision with larger number of gray levels. For LCD applications, where higher performance is needed, the R-DAC column driver may become much larger and more expensive.

Thus, it is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION

Figure 1:
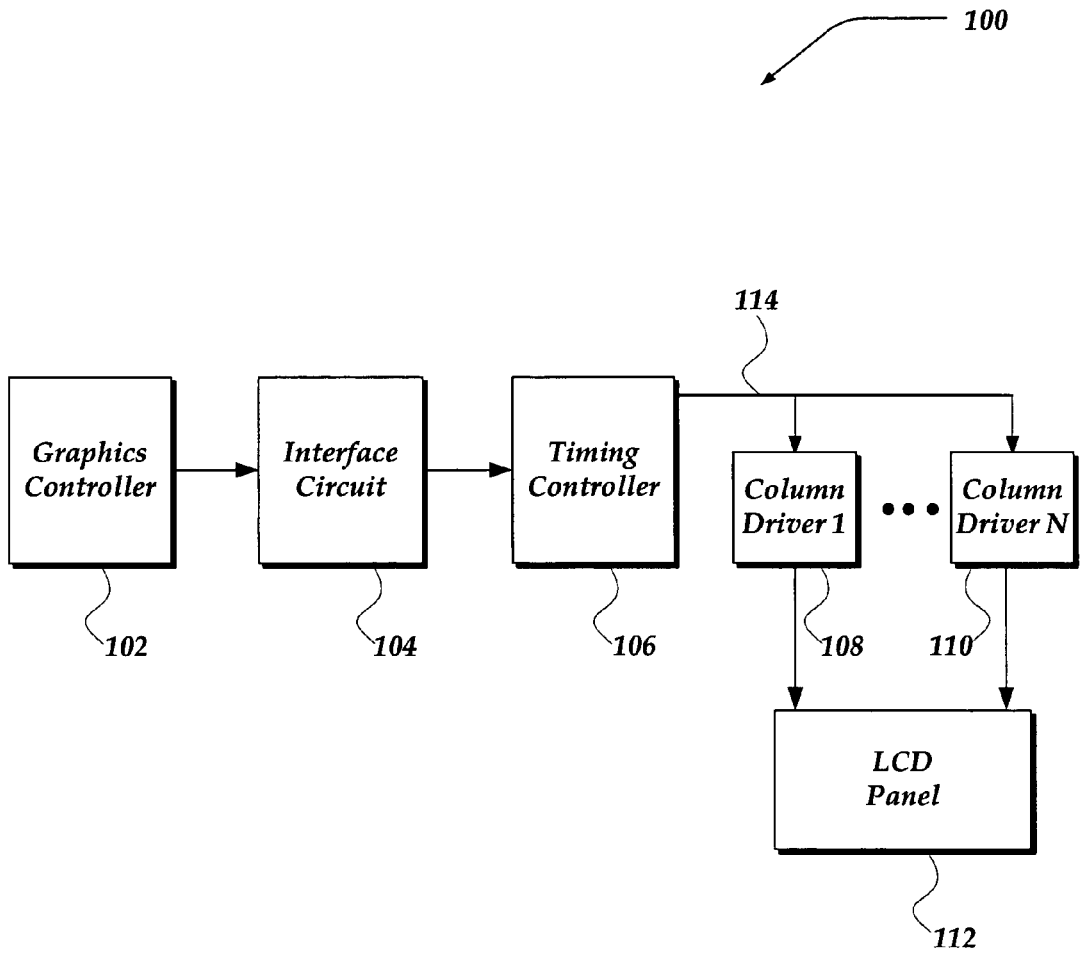
FIG. 1 illustrates a block diagram of an embodiment of an LCD system in which the present invention may be employed.

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment or an embodiment combining software and hardware aspects. The following detailed description is, therefore, not to be taken in a limiting sense.

Briefly stated, the present invention is related to a switched capacitor cyclic digital-analog-conversion circuit that provides an alternative to non-linear resistive DAC circuitry commonly used in LCD column drivers.

In a typical LCD circuit digital voltages that are generated in a graphics controller, the timing controller, and the like are converted to analog voltages for liquid crystals in a DAC circuit in the column driver such as a resistive DAC circuit. Gamma is a value of an exponent in an exponential electro-optic response curve. Unlike Cathode Ray Tubes (CRTs) which have an exponential electro-optic response curve, LCDs do not have gammas, since their responses are not exponential. Liquid crystals respond to square of applied voltage. However, an inverse gamma curve is employed in some LCDs to reduce the effect of the non-exponential behavior between the non-linear DAC circuit and the LCD. Such a gamma curve may be implemented to calibrate an LCD during manufacturing, but temperature dependencies, and the like, may necessitate application of different gamma curves by software, use of different circuitry, and the like.

The non-linear resistive (R-DAC) architecture may efficiently provide an adequate number of gray levels, for example 64 in 6-bit systems, while intrinsically correcting for gamma of the LCD. When all individual resistor strings of each column driver are referenced to same global voltages, the R-DAC architecture may assure identical, part-to-part gray level voltages. However, the R-DAC architecture has its shortcomings when it comes to higher grayscale precision as R-DAC die area grows with number of gray levels. For LCD applications, where added performance of true, 256 gray levels is generally needed, the 8-bit R-DAC column driver may be much larger and more expensive than its 6-bit counterpart. Maintaining a low-cost column driver die while providing up to 10 bits of grayscale ultimately required for TV applications, may severely strain the R-DAC architecture.

The claimed invention may provide a different DAC topology in the column driver with an advantage of smaller die size and more gamma flexibility instead of pushing the R-DAC configuration into a solution for which it is not well suited. Unlike the R-DAC whose non-linear transfer characteristic is hardwired into a resistor string, the claimed DAC circuit is linear over its dynamic range. This allows the inverse gamma curve to be decoupled from the DAC and placed in a look-up table (LUT) in a timing controller, upstream of the column driver. Furthermore, another advantage of the DAC circuit is that the number of bits of grayscale precision does not affect its size, so that progression to 10 bits of grayscale precision does not translate directly into a much larger die-size.

Essentially, the present invention enables a diverse new LCD driver circuit, that allows higher bit rates without a significant increase in circuit size. The circuit described herein may be employed with any LCD known to those skilled in the art.

FIG. 1 illustrates block diagram 100 of an embodiment of an LCD system in which the present invention may be employed. Block diagram 100 includes graphics controller 102, interface circuit 104, timing controller 106, column drivers 108-110, LCD panel 112, and communication bus 114.

Graphics controller 102 is arranged to receive input from a variety of source including, but not limited to, a central processing unit (CPU), an external processor, and the like. Graphics controller 102 is further arranged to perform processes associated with controlling LCD panel 112 and may include subcircuits such as a memory, a processor, and the like. Graphics controller 102 is coupled to interface circuit 104, which is arranged to provide communication between different components of the LCD system. Interface circuit 104 may comprise separate or integrated transmitters and receivers that enable large amounts of data to be transferred between graphics controller 102 and timing controller 106. In one embodiment, interface circuit 104 may be a Low-Voltage-Digital-Signaling (LVDS) transceiver.

Timing controller 106, provides a control for data, control, and clock signals. In a typical LCD system, timing controller may comprise a receiver and a line memory to provide digital voltages to the column drivers. The present invention includes an implementation of the gamma curve in timing controller 106 allowing generation of voltages for each grey level in the timing controller. This in return allows a simple linear digital-to-analog conversion in the following column drivers. The grey level values generated in timing controller 106 are transmitted to the following stage of the LCD system, the column drivers, via communication bus 114. When the gamma curve is implemented in timing controller 106, communication bus 114 does not need to include a line for each possible voltage.

Column drivers 108-110 receive digital grey level values from timing controller 106 and provide an analog voltage to a column of pixel mosaics in LCD panel 112 modifying the luminescence of liquid crystals. Column drivers 108-110 may include a linear DAC such as a switched capacitor cyclic DAC as described in more detail below, and convert the digital grey level values to analog voltages.

LCD panel 112 comprises individual pixel mosaics that change their luminescence based on an applied voltage. LCD panel 112 may be constructed such that individual pixel mosaics are driven in columns. Each column in LCD panel 112 may be supplied with the voltage (also termed grey level value) by a column driver such as column drivers 108-110. LCD panel 112 may employ various technologies including, but not limited to, simple matrix, active matrix, and the like.

FIG. 1 shows a particular arrangement of inputs and outputs of the various components. In one embodiment, all of the components of LCD system except LCD panel 112 may be included in the same chip. Alternatively, one or more of the components of the LCD system may be off-chip.

Figure 2:
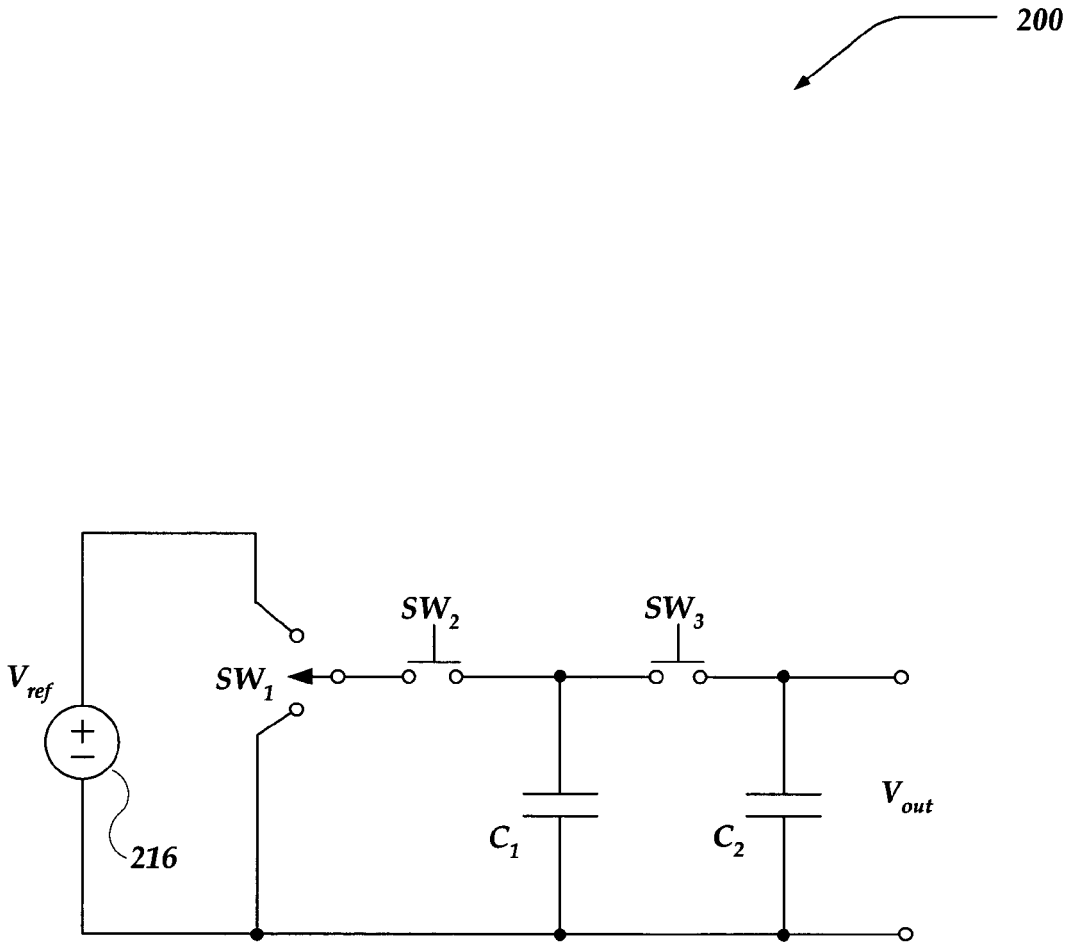
FIG. 2 schematically illustrates a simplified cyclic DAC circuit.

FIG. 2 schematically illustrates simplified cyclic DAC circuit 200. Cyclic DAC circuit 200 includes voltage source 202, switches $SW_1$, $SW_2$, and $SW_3$, and capacitors $C_1$ and $C_2$. Voltage source 202 is positioned between two poles of three-pole switch $SW_1$. A third pole of switch $SW_1$ is coupled to a first pole of two-pole switch $SW_2$. A second pole of switch $SW_2$ is coupled to capacitor $C_1$, which is coupled to a negative terminal of voltage source 202 and one terminal of output voltage $V_{out}$. The second pole of switch $SW_2$ is further coupled to a first pole of two-pole switch $SW_3$. A second pole of switch $SW_3$ is coupled to another terminal of output voltage $V_{out}$ and capacitor $C_2$, which is also coupled to the negative terminal of voltage source 202.

The operation involves pumping charge into or out of $C_2$, cycle-by-cycle, depending on one and zero content of a digital word being converted. Following example assumes $V_{ref}$ equal to 8 Volts and the digital word to be converted is 101. The binary number 101 is 5 in decimal. The DAC may convert 101 to ⅝ of the 8 bit range, in this example, 5 volts. At the beginning output voltage $V_{out}$ may be set to zero by positioning $SW_1$ to ground and closing $SW_2$ and $SW_3$. First, a determination is made whether $SW_1$ selects $V_{ref}$ or ground. Because the first bit is a 1, $SW_1$ may select $V_{ref}$, 8 Volts. Next, $SW_2$ may be closed and 8 Volts appears across $C_1$. Next $SW_2$ may be opened and $SW_3$ may be closed and because $C_1$ and $C_2$ are equal, 4 Volts appears across $C_2$ at the output.

The process begins again as $SW_3$ is opened. This time the next more significant bit is a zero and $SW_1$ selects ground. When $SW_2$ is closed, $C_1$'s voltage is about zero. When $SW_2$ is opened and $SW_3$ is closed the output voltage $V_{out}$ moves from 4 to 2 Volts. Finally, $SW_1$ again selects 8 Volts because the next more significant bit is a one, $C_1$ has 8 Volts until $SW_2$ is opened and $SW_3$ is closed. Since $C_2$ has 2 Volts and $C_1$ has 8 Volts, the resulting voltage is 5 volts ((8+2)/2), an expected value. The choice of the $V_{ref}$ voltage may be arbitrary and more bits of precision only necessitates more DAC cycles rather than additional hardware.

The cyclic DAC is a better choice of DACs over the R-DAC for TV application for two key reasons. A small size required for 10 or 12 bit conversions and because it allows the gamma curve to be implemented in the timing controller rather than hardwired into the column driver.

Figure 3:
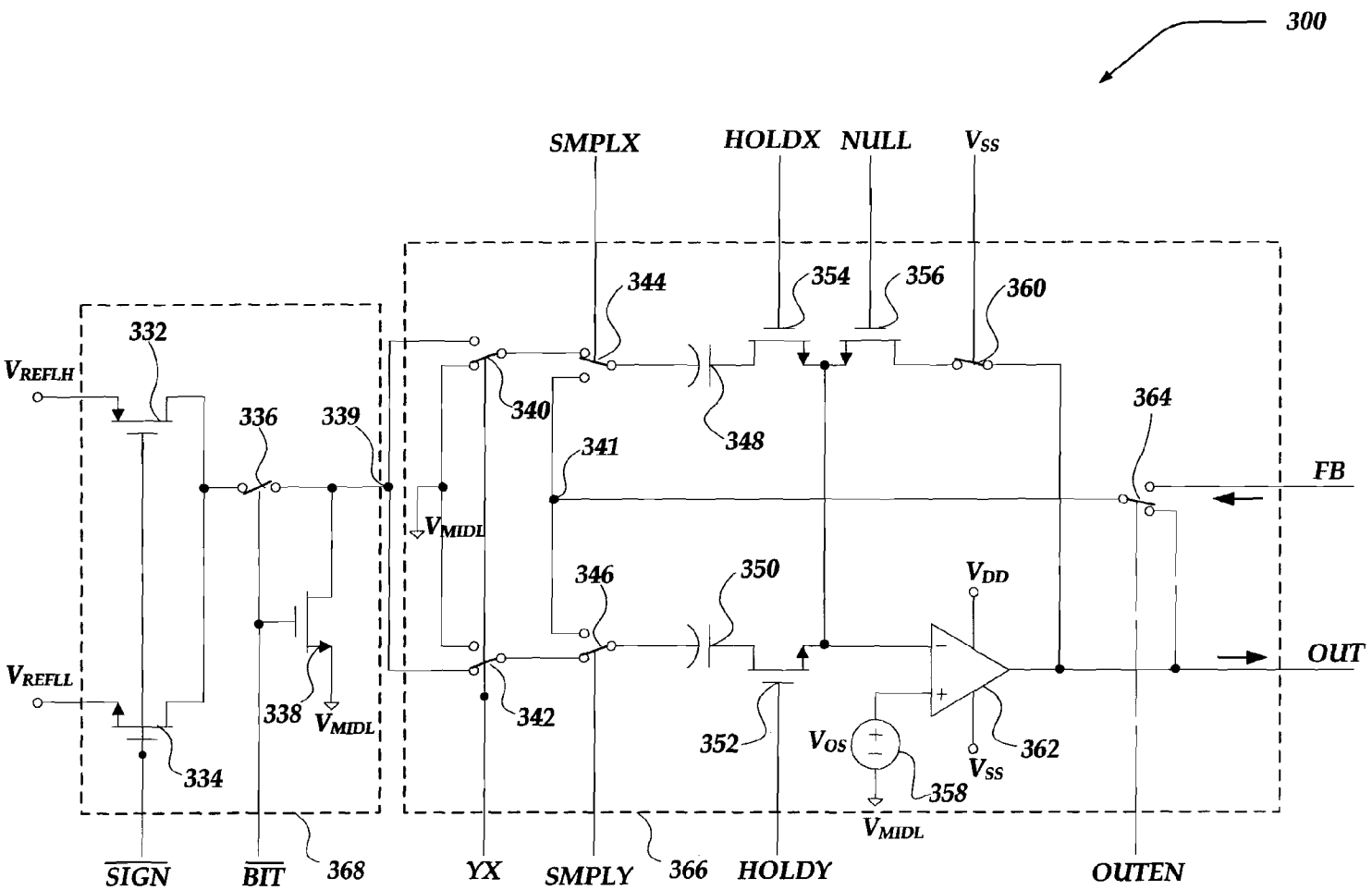
FIG. 3 schematically illustrates a two-capacitor DAC circuit according to the present invention.

FIG. 3 schematically illustrates two-capacitor DAC circuit 300 according to the present invention. DAC circuit 300 includes local input circuit 368 and global conversion circuit 366.

Local input circuit 368 includes transistors 332 and 334 that are arranged to receive a high reference voltage $V_{REFLH}$ and a low reference voltage $V_{REFLL}$, respectively. A local $\overline{SIGN}$ signal is provided to gates of both transistors such that a value of $\overline{SIGN}$ determines which reference voltage is to be used by the circuit. Drains of transistors 332 and 334 are coupled together. A source of transistor 338 is coupled to the drains of transistors 332 and 334 providing a reference signal to global conversion circuit 366 at node 339. A drain of transistor 338 is coupled to middle voltage $V_{MIDL}$. Transistor 338 is controlled by local signal $\overline{BIT}$ provided to its gate. $\overline{BIT}$ further controls switch 336 which allows the low and high reference voltages to be disconnected from global conversion circuit 366.

The reference signal is provided to global conversion circuit 366 through switches 340 and 342. Middle voltage $V_{MIDL}$ is also provided to global conversion circuit through switches 340 and 342. Switches 340 and 342 are controlled by global signal YX that determines which signal may be used to charge capacitors $C_x$ and $C_y$. Capacitor $C_x$ is coupled between switch 344 and a source of transistor 354. Capacitor $C_y$ is coupled between switch 346 and a source of transistor 352. Switch 344 is controlled by global signal SMPLX. SMPLX determines whether $C_x$ is charged by the reference signal or left floating. Switch 346 is controlled by global signal SMPLY. SMPLY determines whether $C_y$ is charged by the reference signal or left floating. In one configuration SMPLX and SMPLY may set switches 344 and 346 such that capacitors $C_x$ and $C_y$ are coupled together. A further setting of transistors 352 and 354 may arrange $C_x$ and $C_y$ to be coupled in parallel such that charges are summed as explained below in conjunction with FIG. 4.

A drain of transistor 354 and transistor 356 are coupled together and connected to a negative input of amplifier 362. Transistor 354 is controlled by global signal HOLDX at its gate. Turning on or off of transistor 354 in conjunction with transistor 356 may determine an amount of charge to be accumulated in capacitor $C_x$ allowing an output voltage $V_{out}$ to be determined based on an input bit value as explained below in FIG. 4. A drain of transistor 352 is also coupled to the negative input of amplifier 362. Transistor 352 is controlled by global signal HOLDY that determines whether $C_y$ is connected to amplifier 362 or not. A source of transistor 356 is coupled through switch 360 to an output of amplifier 362. Transistor 356 is controlled by global signal NULL at its gate. Switch 360 is controlled by rail voltage $V_{ss}$, and is normally in closed position. When switch 360 is closed and transistor 356 is turned on, amplifier 362 may be in a unity gain configuration. Amplifier 362 receives supply voltages from rail voltages $V_{DD}$ and $V_{SS}$. A positive input of amplifier 362 is coupled to a positive terminal of voltage source 358, which provides voltage $V_{OS}$ over middle voltage $V_{MIDL}$. In one embodiment, the positive input of amplifier 362 may be directly coupled to $V_{MIDL}$.

Finally, switch 364 determines whether capacitors $C_x$ and $C_y$ are to be charged by the reference voltage or by external voltage $V_{FB}$ by connecting $V_{FB}$ input to node 341 coupling two poles of switches 344 and 346. In another position switch 364 connects node 341 to the output of amplifier 362. Switch 364 is controlled by global signal OUTEN that enables output of the circuit.

In one embodiment local input circuit 368 may be shared by two global conversion circuits 366. Two DAC's may be employed for each channel because one may provide the output, while the other converts the input bit.

FIG. 3 shows a particular arrangement of components. In one embodiment, all of the components DAC circuit 300 may be included in the same chip. Alternatively, one or more of the components of DAC circuit 300 may be off-chip.

An output voltage $V_{out}$ of the DAC circuit 300 may be expressed by:

$$V_{out} = V_{MIDL} + (S \cdot V_{REFHL} + \overline{S} \cdot V_{REFHL} - V_{MIDL}) \sum_{n=0}^{N-1} \frac{b_n}{2^N - n},$$

where S is a sign bit, N is a total number of bits converted, and $b_n$ is a value of each bit that is converted. The sign bit is not converted, it is merely used to select which reference voltage is to be applied.

Charge injection to the capacitors $C_x$ and $C_y$ may come from three sources: transistor 354 turning off, transistor 356 turning off, and transistor 354 turning on. The charges are represented in the output voltages in FIG. 4 as $Q_{xH}$ and $Q_{Null}$. For example, at the end of phase $\phi 1_0$ transistor 354 is turned off. This injects the charges $\Delta_R Q_{xH}$ to $C_x$ and $\Delta'_R Q_{xH}$ to $C_y$, where the Δ's are portions of a total charge injection from transistor 354. The charge in $C_y$ is removed by amplifier 362, since transistor 356 is still on, and the amplifier remains in a unity gain configuration. When transistor 356 is turned off, the charge $\Delta_N Q_{Null}$ is injected to $C_y$. When transistor 354 is turned on, it injects all of its charge into both capacitors.

An error voltage after an initial transition may be expressed by:

$$V_{err-reset} = \frac{\Delta_R Q_{xH} + \Delta_N Q_{Null} - Q_{xH}}{2C} V.$$

If the portions of the charges injected to the capacitors are $\Delta_R = \Delta_N = 1/2$ and transistors 354 and 356 are virtually identical, then a reset charge $Q_{reset}$ is equal to about zero. A splitting of the charge depends, in part, on an impedance seen by the transistors at their sources and drains. Switch 360, which is coupled in series with amplifier 362's output attempts to match transistors 354 and 365 in series with capacitors 348 and 350. Each cycle of transitions may provide a similar charge injection except for the charge from transistor 354 is slightly different, because one terminal of capacitor 348 is coupled to a different node in subsequent cycles. A total error voltage at the end of the conversion may be expressed by:

$$V_{err-total} = \frac{Q_{reset}}{2^{n+1}C} - \frac{(\Delta_H Q_{xH} + \Delta_N Q_{Null} - Q_{xH})\left(\frac{2^{n-1}}{2^n}\right)}{C} \approx \frac{\Delta_R Q_{xH} + \Delta_N Q_{Null} - Q_{xH}}{2C} V.$$

Again, if the portions of the charges injected to the capacitors can be maintained about $\Delta_H = \Delta_N = 1/2$, the error may be minimal. A source of the majority of error may be capacitor mismatch in the circuit. As mentioned above, two pairs of DAC circuits may be utilized for an upper range and a lower range of grey level values. If the pairs are designated A and B, a standard deviation of outputs assuming randomly distributed, uncorrelated errors may be expressed by:

$$\sigma = \frac{\sqrt{\sigma_{AU}^2 + \sigma_{AL}^2 + \sigma_{BU}^2 + \sigma_{BL}^2}}{4} = \frac{\sigma_{capacitor}}{2}.$$

For example, in a typical 10V system with capacitance of capacitors 348 and 350 about equal to 0.25 pF, the standard deviation of the capacitance error may be $\sigma_{capacitor} = 0.0002$. This would result in a total standard deviation for the chip $\sigma_{chip} = 0.0014$ corresponding to up to 3.17 mV error voltage.

To reduce the error due to capacitor mismatch a size of each capacitor may be increased, but at least a four-fold increase would be necessary for a mere halving of the error. Increasing the capacitance may also lead to an increase in settling time of amplifier 362. A better solution may be utilizing on-off timing of transistor 352 and varying capacitor configuration. Since capacitors 348 and 350 are virtually identical, their roles may be reversed such that capacitor 350 may be integrating and capacitor 348 may be sampling.

Changing configuration of capacitors 348 and 350 may be implemented in at least two ways. Frame swapping may include turning transistor 352 off periodically depending on an even frame number. For example, transistor 352 may be turned off every fourth frame, every eighth frame, and the like, switching the roles of the capacitors. The output voltage may be expressed for frame swapping by:

$$V_{out} = \frac{V_{ref}}{2}\sum_{n=0}^{N-1}\frac{b_n}{\left(1+\frac{C_{348}}{C_{350}}\right)^{N-n}} + \frac{b_n}{\left(1+\frac{C_{350}}{C_{348}}\right)^{N-n}}.$$

$C_{348}$ and $C_{350}$ are capacitances of capacitors 348 and 350, respectively. A numeric analysis of this expression for the above mentioned example of 10V system with 0.25 pF capacitance yields 0.002 mismatch error for frame swapping every fourth frame, and 0.00014 mismatch error for frame swapping every eighth frame.

A second method of changing capacitor roles may be cycle swapping, where transistor 352 is turned off every other cycle switching the capacitors' roles and causing an averaging of the accumulated charge. The output voltage may be expressed for frame swapping by:

$$V_{out} = V_{ref}\sum_{n=0}^{\frac{N-1}{2}}\frac{b_{2n}}{\left(1+\frac{C_{348}}{C_{350}}\right)^{N-2n}} + V_{ref}\sum_{n=1}^{\frac{N-1}{2}}\frac{b_{2n-1}}{\left(1+\frac{C_{348}}{C_{350}}\right)^{N-2n+1}}.$$

A numerical analysis of both swapping methods indicates that frame swapping every eighth frame may be more efficient in reducing capacitor mismatch error. During an operation of DAC circuit 300, data may be transmitted serially through a shift register with one bit for each output channel.

Figure 4A:
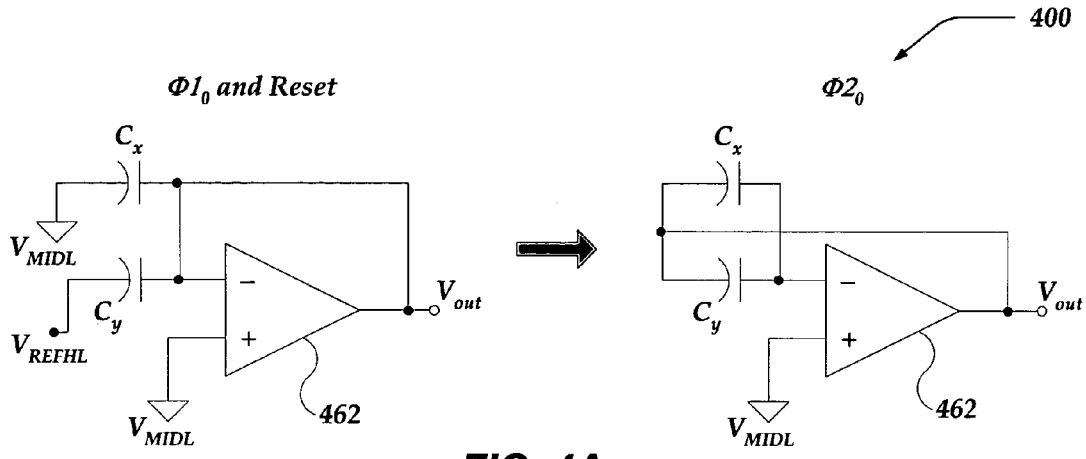
FIGS. 4A-4C schematically illustrate topologies of a two-capacitor DAC circuit in each phase of the conversion.
Figure 4B:
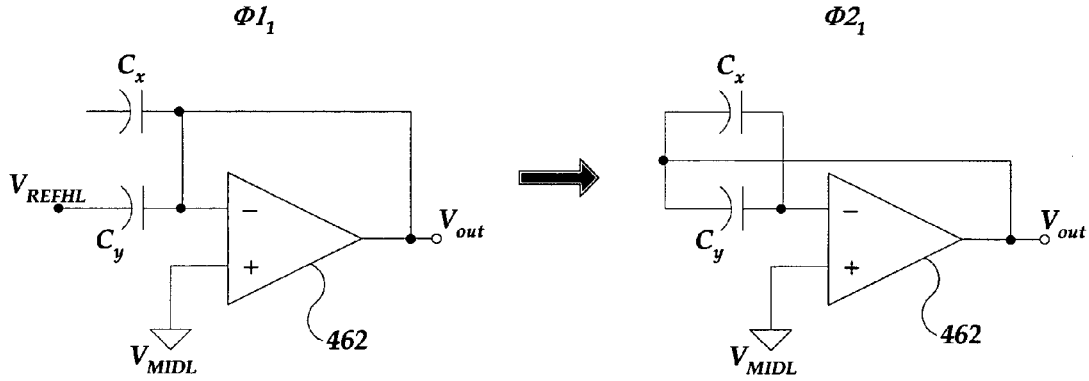
Figure 4C:
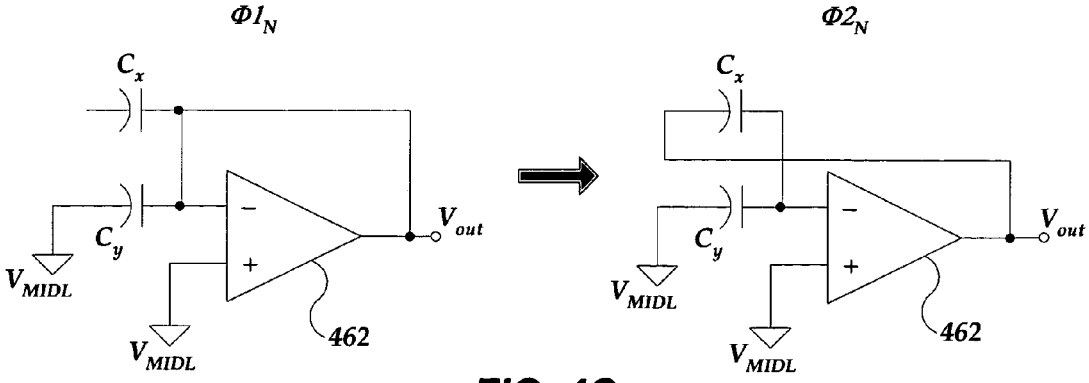

FIGS. 4A-4C schematically illustrate topologies 400 of a two-capacitor DAC circuit in exemplary phases of a digital-analog conversion. Topologies 400 include a simplified representation of the DAC circuit of FIG. 3 when switches are positioned differently in exemplary phases of the conversion.

FIG. 4A shows a transition from reset phase $\phi\mathbf{1}_0$ to phase $\phi\mathbf{2}_0$ during a first cycle. At the beginning, the switches are set such that integration capacitor $C_x$ is coupled between an output of amplifier 462 and a middle voltage $V_{MIDL}$. Sampling capacitor $C_y$ is coupled between a negative or inverting input of amplifier 462 and the high reference voltage $V_{REFHL}$. A positive input of amplifier 462 is coupled to middle voltage $V_{MIDL}$. In this configuration an output voltage $V_{out}$ may be expressed by $V_{out}=V_{MIDL}$, or if a voltage source with $V_{os}$ is coupled between the positive input of amplifier 462 and $V_{MIDL}$, as shown in FIG. 3, $V_{out}=V_{os}$.

After the transition the switches are set such that the $V_{MIDL}$ and $V_{REFHL}$ are removed from the capacitors $C_x$ and $C_y$, and the capacitors are coupled in parallel. This results in a summing of charges in the capacitors such that output voltage $V_{out}$ may be expressed by:

$$V_{out} = \frac{b_0 \cdot V_{REF}}{2} - \frac{\Delta_R Q_{xH} + \Delta_N Q_{Null} - Q_{xH}}{2C},$$

where $b_0$ is the least significant bit and C is a capacitance of the matching capacitors. Charges are as explained in FIG. 3.

FIG. 4B shows a similar transition between two phases of conversion of bit 1. The circuit configurations before (phase $\phi\mathbf{1}_1$) and after (phase $\phi\mathbf{2}_1$) the transition are virtually identical to the configurations in FIG. 4A except for capacitor $C_x$, one terminal of which is left floating instead of being coupled to $V_{MIDL}$. The output voltage before the transition may be expressed similarly by $V_{out}=V_{MIDL}$, or as $V_{out}=V_{os}$. The output voltage after the transition may be expressed by:

$$V_{out} = \left(\frac{b_0}{4} + \frac{b_1}{2}\right)V_{REF} - \frac{\frac{Q_{reset}}{2} + \Delta_H Q_{xH} + \Delta_N Q_{Null} - Q_{xH}}{2C},$$

where $b_1$ is the first bit.

For following bits until the last bit, the configurations before and after the transition in each cycle are similar. The output voltage $V_{out}$ before the transition remains the same, while the output voltage after the transition receives and additional term for each additional bit with the weight of the previous bits being reduced by 2.

Figure 5:
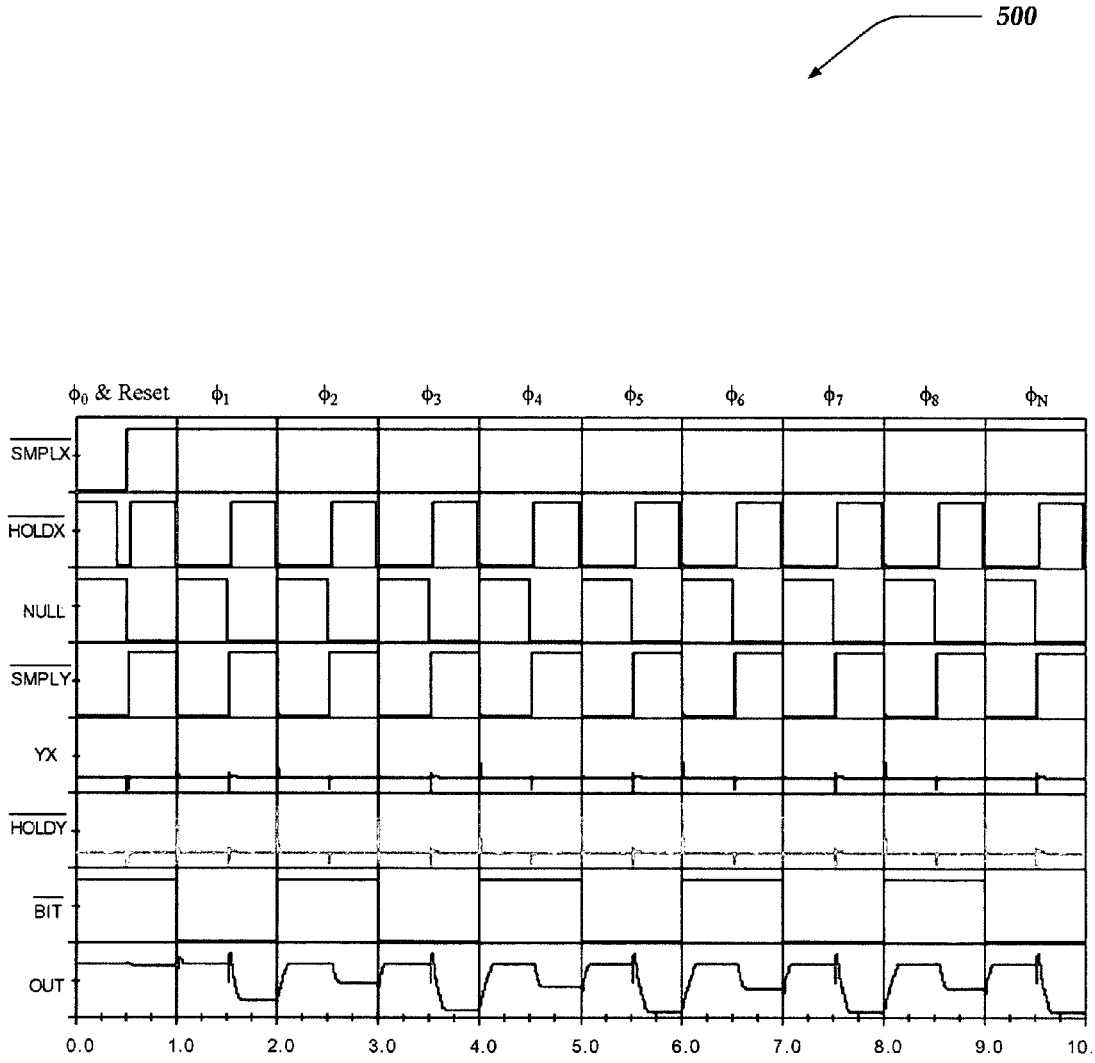
FIG. 5 illustrates a timing diagram of switch control signals during a digital analog conversion by the circuit of FIG. 3.

For the last bit, the configuration before the transition (phase $\phi\mathbf{1}_N$) is again identical to the configuration for previous bits with the output voltage being the same. The configuration after the transition (phase $\phi\mathbf{2}_N$) is, however, different. In this case, switches are set such that the integration capacitor $C_x$ is coupled between the negative input and the output of amplifier 462. Sampling capacitor $C_y$ is coupled between $V_{MIDL}$ and the negative input of amplifier 462. The positive input of amplifier 462 is still coupled to $V_{MIDL}$. Coupling of $C_y$ between $V_{MIDL}$ and the negative input of amplifier 462 enables an attenuation of excursions of the negative input when switch 364 of FIG. 3 is switched from input to output. A final voltage is held in $C_x$ and provided to the output separately through switch 364 of FIG. 3. A timing of the active switches is illustrated in FIG. 5. In phase $\phi\mathbf{2}_N$ after the last transition, the output voltage $V_{out}$ may be expressed by:

$$V_{out} = \left(\frac{D}{2^n}\right)V_{REF} - \frac{Q_{reset}}{2^{n+1}C} - \frac{(\Delta_H Q_{xH} + \Delta_N Q_{Null} - Q_{xH})\left(\frac{2^{n-1}}{2^n}\right)}{C},$$

where D is a summation of all processed bits.

The least significant bit is converted first and its contribution to a final value is divided by $2^{N+1}$. Because the output of amplifier 462 reaches about $$\frac{V_{MIDL} \pm V_{REF}}{2}$$

after the first conversion and about $$\frac{V_{MIDL} \pm 3V_{REF}}{4}$$

after the second conversion, the output does not approach amplifier rail voltage $V_{DD}$ sufficiently to raise supply voltage noise interference concerns. Even if $V_{DD}$ drops at the beginning, by the time the output voltage is sufficiently large (in the last few conversions), $V_{DD}$ will have recovered such that noise interference may be again negligible.

FIG. 5 illustrates timing diagram 500 of selected switch control signals during a digital-analog conversion by the circuit of FIG. 3. Phases of conversion $\phi_0$-$\phi_N$ are represented along the horizontal timeline of timing diagram 500. $\phi_0$-$\phi_N$ correspond to circuit topologies described above in conjunction with FIGS. 4A-4C. Various switch control signals are represented along a vertical axis of timing diagram 500. These signals include $\overline{\text{SMPLX}}$, $\overline{\text{HOLDX}}$, NULL, $\overline{\text{SMPLY}}$, YX, $\overline{\text{HOLDY}}$, $\overline{\text{BIT}}$, and OUT. The signals are depicted in conjunction with the DAC circuit in FIG. 3.

The conversion begins with $\phi_0$, which is also a reset condition. $\overline{\text{SMPLX}}$, controlling switch 344 of FIG. 3, changes from low to high in this phase allowing $C_x$ to be charged by the reference voltage, and remains high through the final phase $\phi_N$. $\overline{\text{HOLDX}}$, controlling transistor switch 354, begins high in reset phase $\phi_0$, briefly drops to low and goes high again. In all of the following phases through phase $\phi_N$, signal $\overline{\text{HOLDX}}$ switches once per cycle from low to high enabling $C_x$ to be coupled in parallel with $C_y$ after each transition. Signal NULL, controlling transistor switch 356 changes from high to low in each phase disconnecting one terminal of $C_x$ from the output of amplifier 462, thereby allowing the charges to be summed between the capacitors.

$\overline{\text{SMPLY}}$, controlling switch 342 of FIG. 3, changes from low to high in each phase allowing decoupling of sampling capacitor $C_y$ from reference voltage during each transition and coupling of the capacitor in parallel with $C_x$. YX and $\overline{\text{HOLDY}}$ remain low, although not zero throughout the operation with small spikes during changing of $\overline{\text{HOLDX}}$ and $\overline{\text{SMPLY}}$ allowing $C_y$ to remain coupled to the negative input of amplifier 462 and be charged by the reference voltage. Signal $\overline{\text{BIT}}$ starts at high value and remains high during every other phase enabling a selection between the reference voltage and middle voltage to be provided to the DAC circuit.

Finally, output signal OUT shows changes in the output of amplifier 462 based on the conversion during each phase depending on the bits that are being converted.

Figure 6:
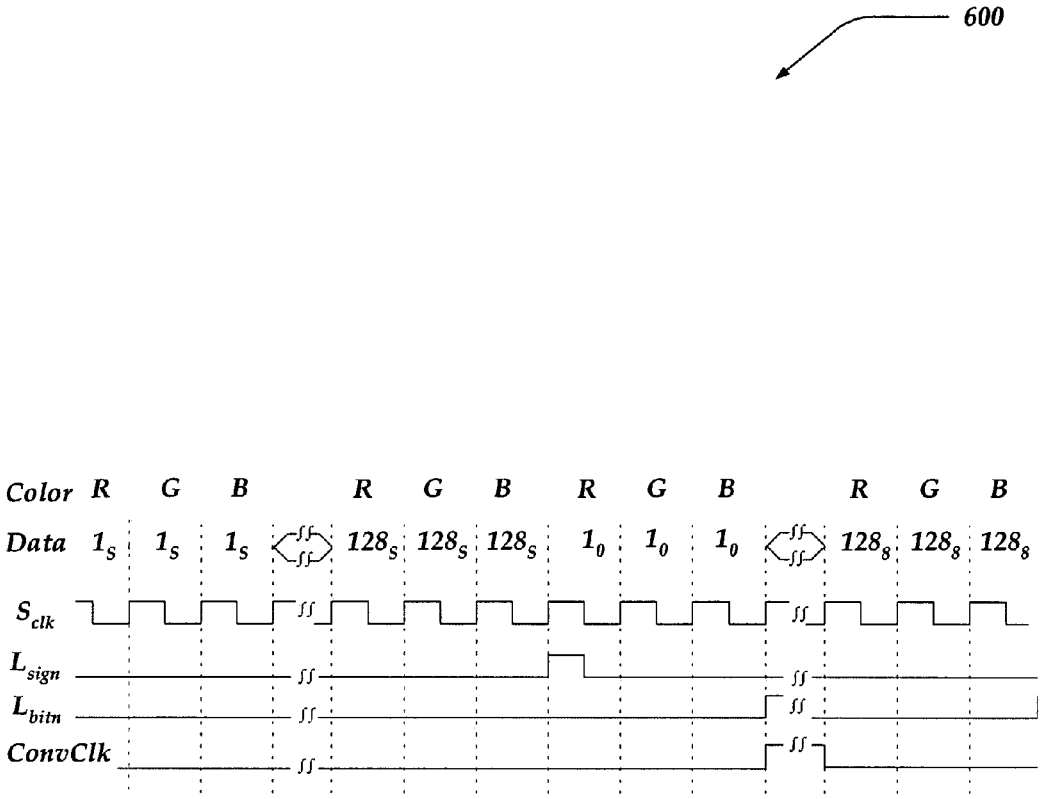
FIG. 6 illustrates a diagram of data exchanged between a timing controlled and a column driver employing the DAC circuit.

FIG. 6 illustrates data diagram 600. Data diagram 600 represents an exemplary set of data exchanged between a timing controller and a column driver employing the DAC circuit in a 10-bit color LCD system.

Data is transmitted serially with one bit for each output channel. In the 10-bit example, 128 bits are transmitted for each color, red (R), blue (B), and green (G). For each color, bits are represented by their channel number. For example, sign bits are designated $\mathbf{1}_S$-$\mathbf{128}_S$, data bits are designated as $\mathbf{1}_0$-$\mathbf{1}_8$ with $\mathbf{1}_0$ representing the least significant bit.

Serial clock (Sclk) is triggered once for each bit in each channel as shown in the figure. Clock signal $L_{sign}$ indicating a beginning of the least significant bit is triggered upon completion of transmission of the sign bits. Clock signal $L_{bim}$ signifies an end of transmission of least significant bits. As described above, the DAC converts digital grey level values beginning with the least significant bits for each color. Finally, a conversion clock signal ConvClk indicates beginning of conversion, when received bits are latched and conversion begins.

The above specification, examples and data provide a description of the manufacture and use of the composition of the invention. Since many embodiments of the invention can be made without departing from the spirit and scope of the invention, the invention also resides in the claims hereinafter appended.

I claim:

1. An LCD driving circuit, comprising:

a timing controller that is arranged to receive pixel data, generate a digital grey level value based on the received pixel data and a predetermined gamma curve, store the digital voltage, and provide the digital voltage to a column driver; and a column driver that is arranged to receive the digital grey level value, convert to an analog voltage, and provide the analog voltage to an LCD column, wherein the conversion is performed by a cyclic digital-analog-converter (DAC), and wherein the cyclic DAC includes:

a first capacitor that is arranged to act as an integrating capacitor; and a second capacitor that is arranged to act as a sampling capacitor.

2. The circuit if claim 1, wherein the cyclic DAC is a linear switched capacitor cyclic DAC.

3. The circuit of claim 1, wherein the cyclic DAC is arranged to convert the digital grey level value to the analog voltage by a predetermined setting of switches in the column driver such that charges in the integrating capacitor and the sampling capacitor are summed and provided to an output of an amplifier based on the digital grey level value.

4. The circuit of claim 3, wherein the digital grey level value is transmitted to the DAC serially such that each bit is converted in a cycle that includes two settings of the switches.

5. The circuit of claim 1, wherein the predetermined gamma curve is implemented through at least one of a look-up table, an interpolation, and an algorithm.

6. The circuit of claim 5, wherein the gamma curve is stored in at least one of a ROM, a RAM, and an EEPROM.

7. The circuit of claim 1, wherein the timing controller employs at least three gamma curves for generating digital grey level values for each of a triplet of primary colors to be used in a color LCD panel.

8. The circuit of claim 1, wherein the cyclic DAC further includes:

a local input circuit that is arranged to receive a first reference voltage, a second reference voltage, a middle voltage, a sign signal, and a digital input signal, and provide a reference voltage to a global conversion circuit based, in part, on the received signals;

the global conversion circuit that is arranged to receive the reference voltage from the local input circuit and provide an analog output voltage based on the reference voltage, the middle voltage and a predetermined number of control signals, wherein the control signals regulate corresponding switches.

9. The circuit of claim 8, wherein the analog output voltage is determined based on an accumulation of a charge in the first capacitor and in the second capacitor.

10. The circuit of claim 8, wherein in one configuration a first pair and a second pair of switches determine whether the charge is provided to the first and second capacitors by the reference voltage or by the middle voltage, and wherein in another configuration the second pair of switches determine whether the capacitors are coupled in parallel such that the charges in the first capacitor and the second capacitor are added.

11. The circuit of claim 8, wherein a first and a second transistor coupled together in the global conversion circuit determine an amount of a charge to be provided to the first capacitor, and wherein a third transistor determines whether the second capacitor is decoupled from an inverting input of an amplifier.

12. The circuit of claim 11, wherein the amplifier is arranged to operate as a unity gain amplifier while the second and third transistors are turned on and the first transistor is turned off.

13. An LCD driving circuit, comprising:

a means for receiving pixel data;

a means for storing a predetermined gamma curve;

a means for generating a digital grey level value based on the received pixel data and the predetermined gamma curve;

a means for storing the digital voltage;

a means for converting the digital voltage to an analog voltage through a cyclic digital-analog conversion means, wherein the cyclic digital-analog conversion means include:

a first capacitor that is arranged to act as an integrating capacitor; and a second capacitor that is arranged to act as a sampling capacitor; and a means for providing the analog voltage to an LCD column.

14. A method for driving an LCD panel, comprising:

receiving pixel data;

storing a predetermined gamma curve, wherein the gamma curve determines a relationship between an applied voltage and a luminescence of an LCD column;

generating a digital grey level value based on the received pixel data and the predetermined gamma curve;

storing the digital voltage;

transmitting the digital voltage to a column driver;

converting the digital voltage to an analog voltage employing a linear DAC circuit, including:

changing switch settings in the linear DAC circuit at least once for each converted bit;

accumulating a charge in capacitors of the circuit based on the settings of switches, wherein one capacitor acts as an integrating capacitor, and the other capacitor acts as a sampling capacitor; and determining the analog voltage based on the accumulated charge; and providing the analog voltage to an LCD column.

15. The method of claim 14, wherein the analog voltage is determined based on a weighted summation of each converted bit.

16. The method of claim 14, wherein the digital-analog conversion begins with a least significant bit.

17. The method of claim 14, wherein the gamma curve is implemented through at least one of:

storing and retrieving the gamma curve in a look-up table;

interpolating a value of the gamma curve from a set of stored values; and employing a predetermined algorithm.

18. The method of claim 14, wherein the gamma curve is loaded to a storage means during manufacturing.

19. The method of claim 14, wherein the gamma curve is retrieved during operation from an external source.

20. The method of claim 14, further comprising swapping the capacitors at least once every other cycle such that the accumulated charge is averaged and a capacitor mismatch error is reduced.

21. The method of claim 14, further comprising swapping the capacitors at least once every fourth frame such that the accumulated charge is averaged and a capacitor mismatch error is reduced.

* * * * *

UNITED STATES PATENT AND TRADEMARK OFFICE

CERTIFICATE OF CORRECTION

PATENT NO. : 7,355,582 B1
APPLICATION NO. : 10/850972
DATED : April 8, 2008
INVENTOR(S) : Bell It is certified that error appears in the above-identified patent and that said Letters Patent is hereby corrected as shown below:

In column 5, line 22, delete "$V_{ss}$," and insert -- $V_{SS}$, --, therefor.

In column 6, line 49, delete "$\sigma_{capacitor=}0.0002$." and insert -- $\sigma_{capacitor}=0.0002$. --, therefor.

In column 7, lines 21-24, delete "$\frac{b_{2n-1}}{\left(1+\frac{C_{348}}{C_{350}}\right)^{N-2n+1}}$." and insert -- $\frac{b_{2n-1}}{\left(1+\frac{C_{350}}{C_{348}}\right)^{N-2n+1}}$. --, therefor.

In column 10, line 15, in Claim 2, delete "if" and insert -- of --, therefor.

Signed and Sealed this

Fifteenth Day of July, 2008

JON W. DUDAS
*Director of the United States Patent and Trademark Office*